US005919124A

United States Patent [19]

Corlett et al.

[11] Patent Number: 5,919,124

[45] Date of Patent: Jul. 6, 1999

[54] APPARATUS FOR CONTINUOUS SEPARATION OF FINE SOLID PARTICLES FROM A LIQUID BY CENTRIFUGAL FORCE

[75] Inventors: Gary L. Corlett, Hollister; Glenn A. Roberson, Jr., Carmel, both of Calif.

[73] Assignee: Lucid Treatment Systems, Inc., Hollister, Calif.

[21] Appl. No.: 08/870,084

[22] Filed: Jun. 5, 1997

[51] Int. Cl.[6] ..... B04B 5/02

[52] U.S. Cl. ..... 494/33; 494/56; 494/57

[58] Field of Search ..... 494/17, 31, 33, 494/43, 44, 56, 61, 62, 67; 210/360.1, 377, 380.1

[56] References Cited

U.S. PATENT DOCUMENTS

| | | | |
|---|---|---|---|
| 717,385 | 12/1902 | Gathmann | 494/33 |
| 943,083 | 12/1909 | Kuchs | 494/33 |
| 1,044,570 | 11/1912 | Raasloff et al. | 494/33 |
| 2,502,704 | 4/1950 | Chisholm | 494/33 |
| 2,510,781 | 6/1950 | Howard . | |
| 3,963,175 | 6/1976 | Daubman et al. . | |
| 3,973,984 | 8/1976 | Hentschel | 494/33 |
| 4,361,480 | 11/1982 | Corbus et al. . | |
| 4,427,407 | 1/1984 | Paschedag . | |
| 4,944,883 | 7/1990 | Schoendorfer et al. . | |
| 4,994,097 | 2/1991 | Brouwers . | |
| 5,148,945 | 9/1992 | Geatz . | |
| 5,222,933 | 6/1993 | Knelson et al. . | |
| 5,330,072 | 7/1994 | Ferri, Jr. et al. . | |
| 5,338,284 | 8/1994 | Knelson . | |
| 5,370,269 | 12/1994 | Bernosky et al. . | |
| 5,372,571 | 12/1994 | Knelson et al. . | |
| 5,591,340 | 1/1997 | Meikrantz et al. . | |

*Primary Examiner*—Charles E. Cooley
*Attorney, Agent, or Firm*—Fulwider Patton Lee & Utecht, LLP

[57] ABSTRACT

The apparatus for the continuous separation of liquid and relatively fine particles from a liquid slurry includes one or more centrifuge vessels disposed about a longitudinal axis of rotation, and a driver for rotating the centrifuge vessel or vessels. A feed inlet introduces the liquid slurry into each centrifuge vessel, each of which extends at an oblique angle to the axis. A first outlet is provided adjacent to the inner end for the lighter liquid component, and a second outlet is provided adjacent to the outer end for the heavier solid particle component. The inlet of the each centrifuge vessel is preferably located between the first end and the second end, and the second outlet preferably comprises a plurality of solids removal capillary passages connected to a continuous solids removal tube, which can be connected to a source of vacuum to form a vacuum chamber for withdrawing the solids. A supernatant liquid collection chamber is also connected to the first outlet for receiving the supernatant liquid.

35 Claims, 1 Drawing Sheet

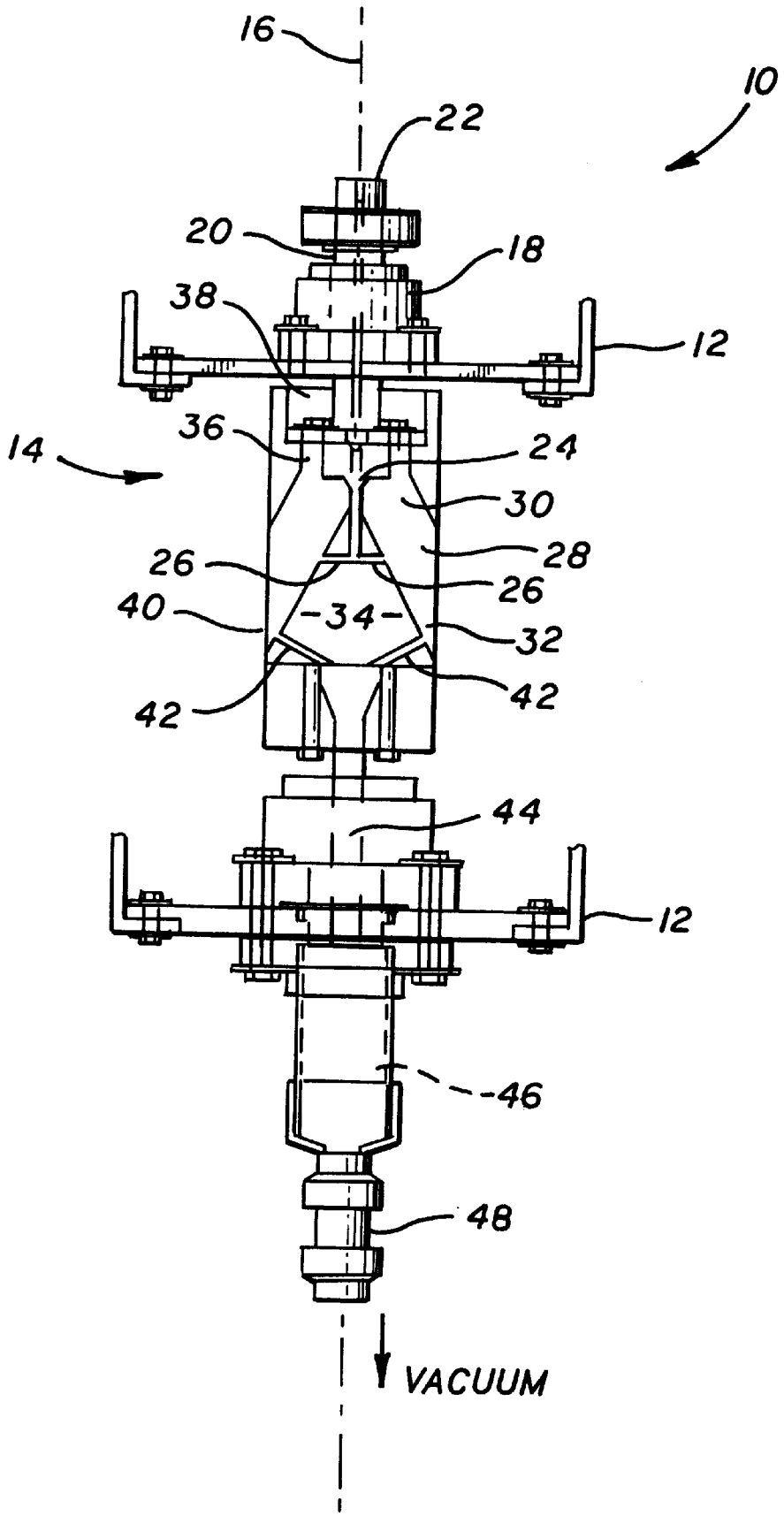
16
10
22
20
18
38
12
36
14
24
30
28
26
26
40
34
32
42
42
44
12
46
48
VACUUM

APPARATUS FOR CONTINUOUS SEPARATION OF FINE SOLID PARTICLES FROM A LIQUID BY CENTRIFUGAL FORCE

BACKGROUND OF THE INVENTION

1. Field of the Invention

This invention relates generally to centrifugal separators for separating mixtures of liquid and solid particles, and more particularly concerns a continuous centrifugal separating apparatus for recovery of components of a slurry containing finely divided, suspended particles.

2. Description of Related Art

Semiconductor components are commonly manufactured by layering electrically conductive and dielectric materials to achieve appropriate electrical characteristics for fabrication of multiple electrical components such as resistors, capacitors and transistors. Many of these discrete devices are incorporated into integrated circuits for use in creating microprocessors, memory chips, logic circuits, and the like. Many integrated circuits can be produced on semiconductor wafers by layering of dielectric and electrically conductive materials to create multiple semiconductor devices in a relatively small area.

The density of electrical components and wiring on such semiconductor devices have continually increased as trace line widths on such semiconductor devices have narrowed. At one time, for example, trace line widths on such devices typically ranged from 1 $\mu$m to 4 $\mu$m. However, in recent years, the industry has made significant advances in reducing trace line widths used in creation of integrated circuits to less than 1 $\mu$m. Currently, trace line widths of 0.5 to 0.35 $\mu$m are common, and research is being done to achieve trace line widths of from 0.25 $\mu$m to 0.18 $\mu$m. In addition, the demand for increased memory and computing power has driven limits on the number of semiconductor devices per integrated circuit ever higher, resulting in an increase in the number of layers applied to semiconductor wafers, while the typical size of the integrated circuits continues to decrease. The combination of narrower trace line widths, increased layers of materials and higher densities of semiconductor devices per integrated circuit has made such devices increasingly susceptible to failure due to inconsistencies on semiconductor wafer surfaces, and it has become increasingly important that such semiconductor wafers have surfaces and dielectric layers that are uniformly smooth.

Methods for chemical and mechanical planarization (CMP) have been developed to polish the surface of semiconductor wafers, and typically involve rotating the wafer on a polishing pad, applying pressure through a rotating chuck, and supplying an aqueous chemical slurry containing an abrasive polishing agent to the polishing pad for both surfactant and abrasive action. The chemical slurry can additionally contain chemicals that etch various surfaces of the wafer during processing. Abrasive agents that can be used in the chemical mechanical slurry include particles of fumed silica, cesium and alumina. The chemical mechanical slurry can also include stabilizer or oxidizer agents. Fumed silica is typically mixed with a stabilizer such as potassium hydroxide or ammonium hydroxide, and is commonly used to polish dielectric or oxide layers on the semiconductor wafer. Cesium and alumina are commonly mixed with an oxidizer agent such as ferric nitrate or hydrogen peroxide, and are typically used to polish metal layers, such as tungsten, copper and aluminum, for example.

The slurry and material removed from the various layers of the semiconductor wafer form a waste stream that is commonly disposed of as industrial waste. The abrasive components constitute approximately 8% to 15% of this waste stream, with the remainder constituting other chemical agents such as stabilizer or oxidizer agents, and water. The waste stream is typically diluted with rinse water to yield a final solids concentration of approximately 1% to 1.5%in the waste stream. These solids are finely divided and composed of a variety of diameters and densities, ranging all the way down to the sub micron range. Particularly in light of recent environmental concerns, it would be desirable to provide a process and apparatus to remove abrasive components from the waste stream for reuse in the chemical mechanical slurry or for other purposes. It would also be desirable to treat and reclaim the waste stream supernatant liquid to permit reuse of the supernatant liquid from the chemical mechanical planarization process.

In order to accomplish these goals, the inventors have developed a process and apparatus to effectively recover the CMP waste components and liquids for reuse. The process and apparatus for performing the process is described in a co-pending application in corporated by reference herein, Ser. No. 08/870,082 filed Jun. 5, 1997, entitled "Method And Apparatus For Recovery Of Water And Slurry Abrasives Used For Chemical And Mechanical Planarization." The present application is for a component of that system, a continuous centrifugal separator. Such a continuous centrifugal separator has important benefits to the system, which does continuous, rather than batch, processing.

Centrifuges are commonly used for separating heterogeneous liquid-liquid or liquid-solid mixtures of different specific gravities and which are not soluble in one another. The physical principle on which the functioning of a centrifuge is based can be explained by first considering what happens when grains of sand suspended in water settle to the bottom. When sand and water in a jar is stirred up, the force of gravity will attract the grains of sand more strongly than the water molecules. The sand grains are therefore rapidly pulled down to the bottom of the jar, in a process described as sedimentation. After a time, the system comes to rest, and two layers will have formed in the jar, with a layer of water over a layer of sand on the bottom of the jar. A similar separation can be performed in a centrifuge, subjecting materials to be separated to a greater centrifugal force instead of gravitational force, allowing separation of materials with different densities in a shorter period of time. The magnitude of the centrifugal force can be increased as desired, and is dependent on the speed of rotation of the centrifuge and the geometry of the fluid passages.

Batch centrifugal separation can be used to separate solids particles ranging in size from the sub-micron level to very large particle sizes. The efficacy of batch centrifugal separators is based on the speed of rotation, the angle of the separation cylinder, and the time that the sample is subjected to high centrifugal forces. Batch centrifugal separators generally can be quite efficient in separating solids from liquids. Continuous centrifugal separators are typically used for separating larger quantities of mixtures; however, continuous centrifugal separators are typically designed to handle larger particle sizes in the range of 5 $\mu$m and greater, although some have accomplished continuous separation of particles in the 1 $\mu$m to 2 $\mu$m range. Conventional continuous centrifugal separators are generally inefficient at separating particles in the sub micron range of 100 nm.

The need exists for a continuous centrifugal separator which can be used in combination with a process relying on electrophoresis and agglomeration techniques to progressively remove particulates from a CMP process. Such a centrifugal separator must be robust, reliable and capable of reclaiming sub micron particles from the liquid base of the incoming waste materials. The present invention satisfies those needs.

SUMMARY OF THE INVENTION

Briefly, and in general terms, the present invention provides for an apparatus for the continuous separation of liquid and relatively fine particles as small as in the sub micron range of 100 nm from an aqueous slurry by centrifugal force, to permit recycling and reuse of the solid particles, and reuse of the aqueous effluent, such as for gray water for irrigation, process cooling water, or as make-up water for a reverse osmosis system, as desired.

The invention accordingly provides for an apparatus for continuous separation of fine solid particles from a liquid by centrifugal force, comprising one or more centrifuge vessels disposed about a longitudinal axis of rotation, and drive means for rotating the centrifuge vessel or vessels about the longitudinal axis of rotation. Each centrifuge vessel extends at an angle to the longitudinal axis of rotation from an inner end to an outer end, with a continuous feed inlet for introducing the liquid slurry into each centrifuge vessel, a first outlet for the centrifuge vessel being located adjacent to the inner end for the lighter liquid component, and a second outlet for the centrifuge vessel adjacent to the outer end for the heavier solid particle component. In one presently preferred embodiment, a plurality of centrifuge vessels are disposed symmetrically at an oblique angle about the longitudinal axis of rotation. The centrifuge vessels are preferably defined in a cylindrical body having a generally conical central body portion. The inlet of the each centrifuge vessel is preferably located intermediate the first end and the second end, and the continuous feed inlet preferably comprises a central feed tube connected to a plurality of peripheral branches connected in flow communication with each centrifuge vessel. The second outlet preferably comprises a plurality of solids removal capillary passages, and in a currently preferred embodiment, the plurality of solids removal capillary passages are connected to a continuous solids removal tube. In another presently preferred embodiment, the continuous solids removal tube is connected to a solids collection chamber, which can be connected to a source of vacuum to form a vacuum chamber for withdrawing solids from the continuous solids removal tube. In a presently preferred embodiment, a supernatant liquid collection chamber is also connected in fluid communication with the first outlet for receiving the lighter liquid component.

In a presently preferred embodiment, a plurality of the centrifuge vessels are disposed symmetrically in a centrifuge body mounted to a housing for rotation about the longitudinal axis of rotation, and the centrifuge body has a center shaft with a continuous feed inlet for receiving the liquid slurry that is connected to the inlet for each centrifuge vessel. The centrifuge vessels may also be of curvilinear centerline and with variable cross section, as well as asymmetric cross section and may be open on all or a portion of one of the sides of the vessel in order to provide for specific performance benefits with a variety of slurries and centrifuge rotational speeds.

These and other aspects and advantages of the invention will become apparent from the following detailed description and the accompanying drawings, which illustrate by way of example the features of the invention.

BRIEF DESCRIPTION OF THE DRAWINGS

The FIGURE is a cross-sectional schematic diagram of the apparatus of the invention for separation of liquid and solid abrasives by centrifugal force.

DETAILED DESCRIPTION OF THE PREFERRED EMBODIMENTS

While continuous centrifugal separators are commonly useful for separating large quantities of mixtures, conventional continuous centrifugal separators are typically inefficient for separation of particles smaller than about 1 $\mu$m, such as particles in the sub micron range of 100 $\mu$m. While batch centrifugal separators are generally efficient for separating smaller size particles from liquids, batch centrifugal separators typically do not provide a high capacity needed for recovery of particulates such as the abrasive polishing agents used in aqueous chemical slurries for polishing the surface of semiconductor wafers, and which are commonly disposed of as industrial waste.

As is illustrated in the Figure the invention is embodied in a continuous centrifugal separator apparatus 10 for separating lighter liquid and heavier solid particle components of a liquid slurry by centrifugal force. The apparatus includes a housing 12, a centrifuge body 14 mounted to the housing for rotation about a longitudinal axis of rotation 16, and a drive gear from the motor 18 mounted to the housing for rotating the centrifuge body about the longitudinal axis of rotation. The cylindrical centrifuge body typically has a center shaft 20 with a continuous feed inlet or spout 22 for receiving the liquid slurry. A feed tube 24 is connected to the continuous feed inlet, and is preferably connected to a plurality of peripheral branches 26 connected in flow communication with one or more centrifuge vessels 28 for introducing the liquid slurry into the plurality of centrifuge vessels.

In a presently preferred embodiment, a plurality of the centrifuge vessels are disposed symmetrically in the centrifuge body about the longitudinal axis of rotation. Each of the centrifuge vessels has an inner end 30 and an outer end 32, with the branch inlets of the plurality of centrifuge vessels being located between the inner end and the outer end of the centrifuge vessels. The plurality of centrifuge vessels preferably extend at an oblique angle to the longitudinal axis of rotation from the inner end to the outer end, and are defined in the cylindrical centrifuge body about a generally conical central body portion 34.

Each of the centrifuge vessels also has a first outlet 36 adjacent to the inner end for the lighter, supernatant liquid component of the slurry, and in a presently preferred embodiment, a supernatant liquid collection chamber 38 is connected in fluid communication with the first outlet for receiving the lighter liquid component. Each centrifuge vessel also has a second outlet 40 adjacent to the outer end for the heavier solid particle component, and in a presently preferred embodiment, the second outlet comprises at least one solids removal capillary passage 42. In a presently preferred embodiment, a plurality of solids removal capillary passages are provided. The solids removal capillary passages are preferably connected to a continuous solids removal tube 44. The continuous solids removal tube is also preferably connected to a solids collection chamber 46, which can also be connected to a source of vacuum (not shown) for further withdrawing liquid from the solids removed, so that the solids collection chamber can then additionally have the function of a vacuum chamber. The solids collection chamber is preferably connected to a solids outlet line 48 from centrifugal separator.

While the centrifuge vessels have been described as cylindrical and at an oblique angle to the rotary axis of the centrifuge, the vessels may also be advantageously of variable cross section, at a variety of angles to the rotary axis and with curvilinear center lines to promote improved efficiency for various particulate consistencies and fluid viscosities, and to accommodate variations in size, rotary velocity and throughput for the centrifuge. Those skilled in the art will also appreciate that the vessels may be open on all or a portion of the side of the vessel for the purpose of improved performance.

It will also be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. An apparatus for continuously separating lighter liquid and heavier solid particle components of a liquid slurry by centrifugal force, comprising:

a cylindrical centrifuge body having a generally conical central body portion;

a least one centrifuge vessel defined in said centrifuge body, said at least one centrifuge vessel being disposed about a longitudinal axis of rotation, said at least one centrifuge vessel having an inner end and an outer end, said at least one centrifuge vessel extending at an angle to said longitudinal axis rotation from said inner end to said outer end, said at least one centrifuge vessel having a first outlet adjacent to said inner end for the lighter liquid component, a second outlet adjacent to said outer end for the heavier solid particle component, and a continuous feed inlet for introducing the liquid slurry into said at least one centrifuge vessel; and drive means for rotating said at least one centrifuge vessel about said longitudinal axis of rotation.

2. The apparatus of claim 1, wherein said at least one centrifuge vessel extends at an oblique angle to said longitudinal axis of rotation.

3. The apparatus of claim 1, comprising a plurality of centrifuge vessels disposed symmetrically about said longitudinal axis of rotation.

4. The apparatus of claim 1, wherein said continuous feed inlet of said at least one centrifuge vessel is connected to said centrifuge vessel intermediate said inner end and said outer end.

5. The apparatus of claim 1, wherein said continuous feed inlet comprises a central feed tube connected to a plurality of peripheral branches connected in flow communication with said at least one centrifuge vessel.

6. The apparatus of claim 1, further comprising a supernatant liquid collection chamber connected in fluid communication with said first outlet for receiving the lighter liquid component.

7. The apparatus of claim 1, wherein said second outlet comprises at least one solids removal capillary passage.

8. The apparatus of claim 1, wherein said second outlet comprises a plurality of solids removal capillary passages.

9. The apparatus of claim 8, wherein said plurality of solids removal capillary passages are connected to a continuous solids removal tube.

10. The apparatus of claim 9, wherein said continuous solids removal tube is -connected to a solids collection chamber.

11. The apparatus of claim 10, wherein said solids collection chamber is connected to a source of vacuum to form a vacuum chamber.

12. An apparatus for the continuous separation of lighter liquid and heavier solid particle components of a liquid slurry by centrifugal force, comprising:

a housing;

a cylindrical centrifuge body mounted to said housing for rotation about a longitudinal axis of rotation, said centrifuge body having a generally conical central body portion and a center shaft with a continuous feed inlet for receiving the liquid slurry;

at least one centrifuge vessel disposed in said centrifuge body about said longitudinal axis of rotation, said at least one centrifuge vessel having an inner end and an outer end, said at least one centrifuge vessel extending at an oblique angle to said longitudinal axis of rotation from said inner end to said outer end, said at least one centrifuge vessel having a first outlet adjacent to said inner end for the lighter liquid component, a second outlet adjacent to said outer end for the heavier solid particle component, and a feed tube connected to said continuous feed inlet for introducing the liquid slurry into said at least one centrifuge vessel; and a shaft for rotating said centrifuge body about said longitudinal axis of rotation.

13. The apparatus of claim 12, comprising a plurality of centrifuge vessels disposed symmetrically about said longitudinal axis of rotation.

14. The apparatus of claim 12, wherein said continuous feed inlet of said at least one centrifuge vessel is connected to said centrifuge vessel intermediate said inner end and said outer end.

15. The apparatus of claim 12, wherein said continuous feed inlet comprises a central feed tube connected to a plurality of peripheral branches connected in flow communication with said at least one centrifuge vessel.

16. The apparatus of claim 12, further comprising a supernatant liquid collection chamber connected in fluid communication with said first outlet for receiving the lighter liquid component.

17. The apparatus of claim 12, wherein said second outlet comprises at least one solids removal capillary passage.

18. The apparatus of claim 12, wherein said second outlet comprises a plurality of solids removal capillary passages.

19. The apparatus of claim 18, wherein said plurality of solids removal capillary passages are connected to a continuous solids removal tube.

20. The apparatus of claim 19, wherein said continuous solids removal tube is connected to a solids collection chamber.

21. The apparatus of claim 20, wherein said solids collection chamber is connected to a source of vacuum to form a vacuum chamber.

22. An apperatus for continuous seperation of fine solid particles from a liquid by certrifugal force, comprising:

a housing;

a cylindrical centrifuge body mounted to said housing for rotation about a longitudinal axis of rotation, said centerifuge body having a generally conical body portion and a center shaft with a continuous feed inlet for receiving a liquid slurry containing the liquid and the fine solid particles, the fine solid particles having a greater specific gravity than the liquid;

a plurality of centrifuge vessels disposed symmetrically in said centrifuge body about said longitudinal axis of rotation, said plurality of centrifuge vessels having an inner end and an outer end, said plurality of centrifuge vessels extending at an oblique angle to said longitudinal axis of rotation from said inner end to said outer end, said plurality of centrifuge vessels having a first outlet adjacent to said inner end for the liquid, a second outlet adjacent to said outer end for the solid particles, and a feed tube connected to said continuous feed inlet for introducing the liquid slurry into said plurality of centrifuge vessels; and a drive shaft for rotating said centrifuge body about said longitudinal axis of rotation.

23. The apparatus of claim 22, wherein said continuous feed inlet of said plurality of centrifuge vessels is connected to said centrifuge vessels intermediate said inner end and said outer end.

24. The apparatus of claim 22, wherein said continuous feed inlet comprises a central feed tube connected to a plurality of peripheral branches connected in flow communication with said plurality of centrifuge vessels.

25. The apparatus of claim 22; further comprising a supernatant liquid collection chamber connected in fluid communication with said first outlet for receiving the lighter liquid component.

26. The apparatus of claim 22, wherein said second outlet comprises a plurality of solids removal capillary passages.

27. The apparatus of claim 26, wherein said plurality of solids removal capillary passages are connected to a continuous solids removal tube.

28. The apparatus of claim 27, wherein said continuous solids removal tube is connected to a solids collection chamber.

29. The apparatus of claim 28, wherein said solids collection chamber is connected to a source of vacuum to form a vacuum chamber.

30. An apparatus for continuously separating lighter liquid and heavier solid particle components of a liquid slurry by centrifugal force, comprising:

a centrifuge body having a generally conical central body portion;

a least one centrifuge vessel defined in said centrifuge body, said at least one centrifuge vessel being disposed about a longitudinal axis of rotation, said at least one centrifuge vessel having an inner end and an outer end, said at least one centrifuge vessel extending at an angle to said longitudinal axis rotation from said inner end to said outer end, said at least one centrifuge vessel having a first outlet adjacent to said inner end for the lighter liquid component, a second outlet adjacent to said outer end for the heavier solid particle component, said second outlet comprising a plurality of solids removal capillary passages connected to a continuous solids removal tube that is in turn connected to a solids collection chamber, and a continuous feed inlet for introducing the liquid slurry into said at least one centrifuge vessel; and drive means for rotating said at least one centrifuge vessel about said longitudinal axis of rotation.

31. The apparatus of claim 30, wherein said solids collection chamber is connected to a source of vacuum to form a vacuum chamber.

32. An apparatus for the continuous separation of lighter liquid and heavier solid particle components of a liquid slurry by centrifugal force, comprising:

a housing;

a centrifuge body mounted to said housing for rotation about a longitudinal axis of rotation, said centrifuge body having a generally conical central body portion and a center shaft with a continuous feed inlet for receiving the liquid slurry;

at least one centrifuge vessel disposed in said centrifuge body about said longitudinal axis of rotation, said at least one centrifuge vessel having an inner end and an outer end, said at least one centrifuge vessel extending at an oblique angle to said longitudinal axis of rotation from said inner end to said outer end, said at least one centrifuge vessel having a first outlet adjacent to said inner end for the lighter liquid component, a second outlet adjacent to said outer end for the heavier solid particle component, said second outlet comprising a plurality of solids removal capillary passages connected to a continuous solids removal tube that is in turn connected to a solids collection chamber, and a feed tube connected to said continuous feed inlet for introducing the liquid slurry into said at least one centrifuge vessel; and a shaft for rotating said centrifuge body about said longitudinal axis of rotation.

33. The apparatus of claim 32, wherein said solids collection chamber is connected to a source of vacuum to form a vacuum chamber.

34. An apparatus for continuous separation of fine solid particles from a liquid by centrifugal force, comprising:

a housing;

a centrifuge body mounted to said housing for rotation about a longitudinal axis of rotation, said centrifuge body having a generally conical central body portion and a center shaft with a continuous feed inlet for receiving a liquid slurry containing the liquid and the fine solid particles, the fine solid particles having a greater specific gravity than the liquid;

a plurality of centrifuge vessels disposed symmetrically in said centrifuge body about said longitudinal axis of rotation, said plurality of centrifuge vessels having an inner end and an outer end, said plurality of centrifuge vessels extending at an oblique angle to said longitudinal axis of rotation from said inner end to said outer end, said plurality of centrifuge vessels having a first outlet adjacent to said inner end for the liquid, a second outlet adjacent to said outer end for the solid particles, said second outlet comprising a plurality of solids removal capillary passages connected to a continuous solids removal tube that is in turn connected to a solids collection chamber, and a feed tube connected to said continuous feed inlet for introducing the liquid slurry into said plurality of centrifuge vessels; and a drive shaft for rotating said centrifuge body about said longitudinal axis of rotation.

35. The apparatus of claim 34, wherein said solids collection chamber is connected to a source of vacuum to form a vacuum chamber.

* * * * *